United States Patent [19]

Lane et al.

[11] 4,324,525

[45] Apr. 13, 1982

[54] LOADING APPARATUS

[75] Inventors: John Lane, Youngstown; Jerry C. Tu, Medina, both of Ohio

[73] Assignee: Anvil Attachments, Inc., Brecksville, Ohio

[21] Appl. No.: 122,132

[22] Filed: Feb. 19, 1980

[51] Int. Cl.[3] ..... E02F 3/82; E02F 3/86

[52] U.S. Cl. ..... 414/699; 414/717; 414/722

[58] Field of Search ..... 414/705, 715, 717, 686, 414/722, 726, 716, 699; 37/117.5, 118 A, 103

[56] References Cited

U.S. PATENT DOCUMENTS

| | | | |
|---|---|---|---|
| 3,207,342 | 9/1965 | Trojan | 414/705 |
| 3,268,101 | 8/1966 | Pensa | 414/705 |
| 3,529,740 | 9/1970 | Chant | 414/715 X |
| 4,080,746 | 3/1978 | Frazzini | 414/722 X |

*Primary Examiner*—Trygve M. Blix

*Assistant Examiner*—Terrance L. Siemens

*Attorney, Agent, or Firm*—Watts, Hoffmann, Fisher & Heinke Co.

[57] ABSTRACT

A bucket assembly and operating system for a conventional front end loader that increases the dump height for a given boom length. The bucket assembly includes a cradle pivotally attached to the end of a boom and a bucket rotatably supported by the cradle. Rotative movement in the cradle and bucket between rollback and dump positions is accomplished by fluid pressure operated actuators controlled by a fluid pressure control system. Sequence valves forming part of the control system are utilized to delay the application of fluid pressure to certain actuators so that sequential motion in the cradle and bucket is achieved without the necessity of additional operator controls. A bucket latching mechanism mechanically locks the bucket in its rollback position until the bucket dump sequence is initiated.

6 Claims, 10 Drawing Figures

Fig. 3
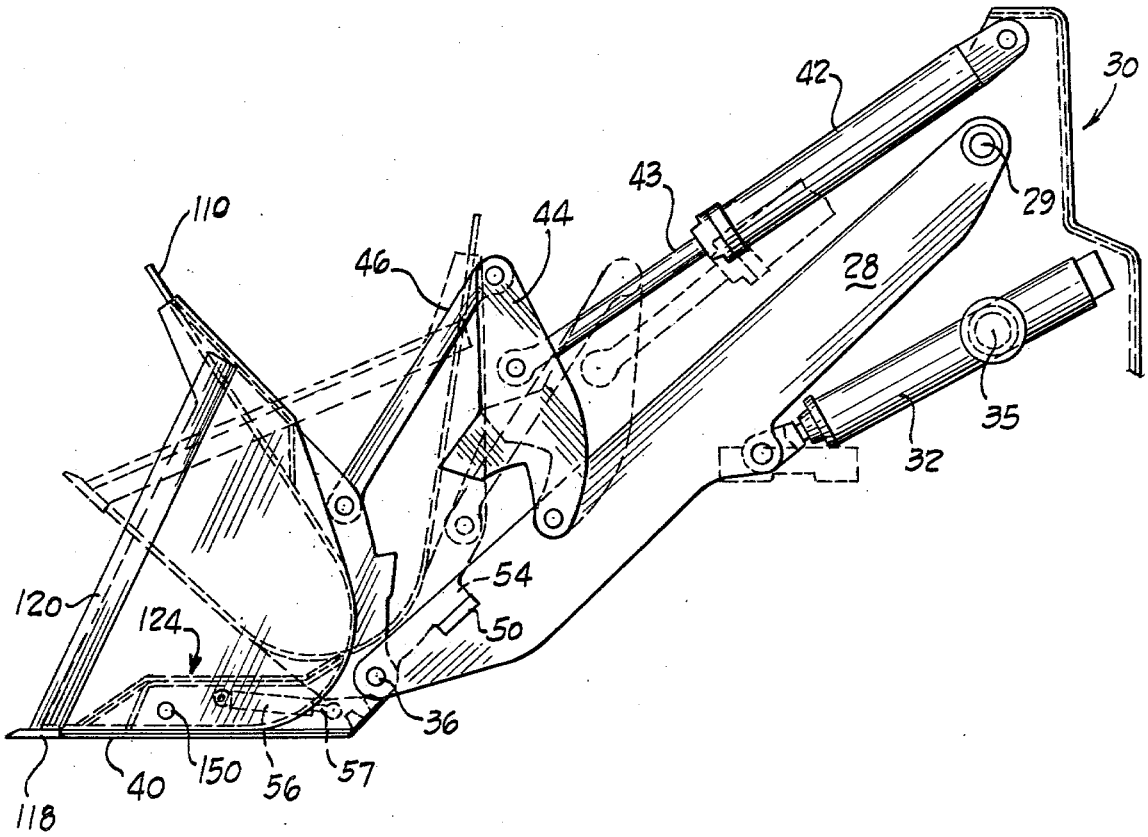
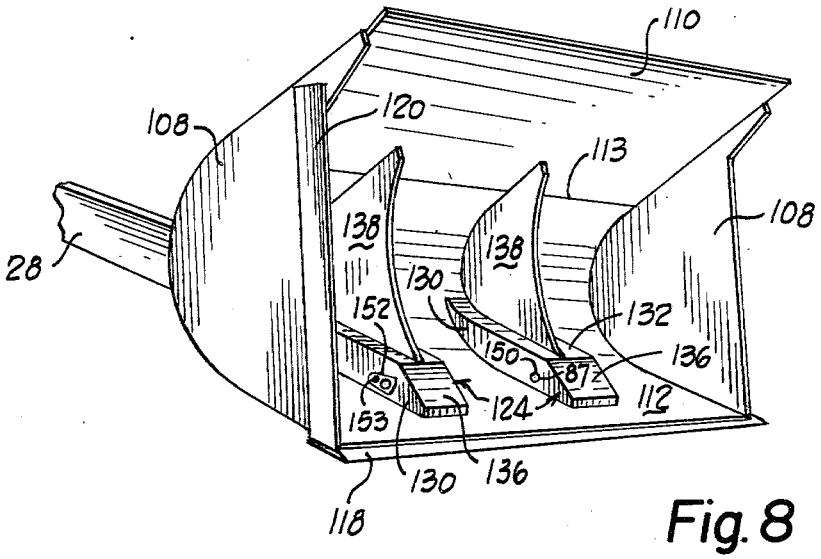
Fig. 8

LOADING APPARATUS

BACKGROUND OF THE INVENTION

The present invention relates generally to loader type vehicles and in particular to a bucket assembly for a front end loader.

Loaders, whether they be of the tractor or wheeled variety, are conventionally employed in excavation to haul, dig or lift earth and refuse. Typically, a loader includes a boom assembly pivotally mounted to one end of the vehicle for raising and lowering a loading bulket.

The dump height of a loader is the maximum vertical distance attainable between the ground and the leading edge of the bucket, when the boom is raised and the bucket is in its full dump position. This maximum distance is governed primarily by the length of the boom and to a lesser extent by the location of the pivot point of the bucket. The bucket is emptied of its contents by rotating it about a horizontal axis until the outward or leading edge is below the bottom of the bucket. The position of the rotational axis of the bucket will determine the final maximum dump height for a given boom length. If the axis is located near the bottom of the bucket, dump height will be reduced because the leading edge will travel downwardly a substantial vertical distance in order to accomplish the dump. If the axis is located near the leading edge of the bucket, the bottom of the bucket is raised until it is above the leading edge and the dump height is at a maximum.

Loading vehicles available from original equipment manufacturers are generally supplied with fixed boom lengths and bucket capacities for a given size vehicle. In a front end loader, a fully loaded bucket genrates a substantial moment or tilting force about the axis of the front wheels. This force is a function of the weight of the load and the length of the moment arm, that is, the horizontal distance between the front wheel axis and the center of gravity of the loaded bucket. In order to maintain vehicle stability, the loaded bucket must be adequately counterbalanced and thus, boom length and bucket capacity can not be arbitrarily selected. Consideration must be given to the vehicle weight and to the expected moment forces generated by the loaded bucket which tend to tilt or even overturn the vehicle.

With present constructions, a higher dump height can be achieved either by purchasing a larger vehicle or resorting to after-market attachments or modifications. The first choice may be unacceptable because of high cost. The second alternative may not be practical because modifications to the boom and bucket can result in a cumbersome operation and instability of the vehicle.

As discussed above, the bucket capacity and boom length must be selected in accordance with the gross vehicle weight in order to preserve vehicle stability. After market modifications that include a boom extension must provide compensation for the added moment forces generated by the increased moment arm and avoid detrimentally affecting the handling and stability of the vehicle. The boom extension increases the horizontal distance between the center of gravity of a loaded bucket and the front wheel axis and thus, the moment forces tending to overturn the vehicle are increased. To compensate for these increased forces, additional counter weight way must be provided or alternately, the load capacity of the bucket must be decreased.

Another possible vehicle modification to increase dump height is the relocation of the bucket pivot point, the object being to minimize the downward travel of the leading edge of the bucket. As noted above, this can be accomplished by locating the pivot near the leading edge so that the bottom of the bucket is lifted above the pivot point to accomplish the dump. This modification generally requires a substantial change in the bucket operating linkage and in one known case, requires the replacement of fixed OEM linkage with variable extension, fluid operated actuators. An additional operator-actuated hydraulic control is necessary to effect movement of the additional actuators. The additional operator control together with the added hydraulic equipment makes this alternative method of increasing dump height objectionable.

SUMMARY OF THE INVENTION

The present invention comprises a novel loading apparatus for a loader-type vehicle and a method of operating the apparatus so as to increase the dump height of the vehicle for a given boom length. When installed on a vehicle, the present invention does not require additional counterweight or additional operator controls.

In a preferred embodiment, the loading apparatus comprises a source of pressurized fluid and a boom assembly for raising and lowering a bucket assembly. The boom assembly preferably includes at least two arms pivotally attached to the vehicle and further includes fluid pressure operated actuators for raising and lowering the arms.

The bucket assembly includes a bucket support subassembly or cradle which pivotally supports a bucket and, in turn, is pivotally supported by the boom assembly. Rotative movement of the cradle between rollback and dump positions is controlled by fluid pressure actuators and associated linkage mounted on the boom assembly. The bucket itself is rotatable between its own rollback and dump positions within the cradle, the rotation of the bucket being effected by fluid pressure operated actuators that act between the cradle and the bucket.

The present invention maximizes bucket dump height for a given boom length. The invention can be incorporated in new vehicles during manufacture, but equally important can be retrofitted to existing equipment. The retrofit requires only minimal modification to the existing vehicle and hydraulic system. The novel bucket assembly replaces the conventional unitary bucket normally fitted to the end of the boom as received from the manufacturer and further requires only a minor change in the hydraulic without necessitating a change in the operator controls.

According to a feature of the invention, the cradle is pivotally attached to the end of the boom and is operatively connected to the linkage and hydraulic actuators that normally effect movement of the conventional bucket. When the present invention is retrofitted to an existing loader, the cradle attachment points correspond to the attachment points of the bucket it is replacing. The bucket assembly which comprises the cradle and bucket is pivoted along the same axis as the original equipment bucket whereas the bucket itself rotates within the cradle on an axis spaced from the end of the boom.

The present invention is easily adaptable to existing equipment and because it does not increase overall boom length, does not require additional counterweight or vehicle modifications. Because it replaces the original equipment bucket and attaches to the boom assembly at the original attachment point, installation is greatly facilitated.

In a preferred embodiment of the invention, sequencing valves are employed to control the flow of fluid pressure to the cradle and bucket actuators. The fluid pressure control system includes a source of pressurized fluid and an operator actuated control for controlling the application of the pressurized fluid to the hydraulic actuators of the bucket assembly. The sequencing valves are interposed in the fluid pressure circuit to provide sequential motion in the components that comprise the bucket assembly, namely, the cradle and bucket. When the operator control is moved to the dump position, pressurized fluid is directed to the cradle actuators. A sequencing valve initially prevents the flow of pressurized fluid to the bucket actuators. Once the cradle reaches its maximum point of travel, the sequence valve responds to the sudden increase in pressure in the conduits feeding pressurized fluid to the cradle actuators and opens to allow the flow of pressurized fluid to the bucket actuators. Thus, sequential operation in which the cradle tilts forward prior to rotation of the bucket is accomplished.

Preferably, another sequencing valve is employed to provide sequential rollback of the cradle and bucket. According to this feature, when the operator control is moved to its rollback position, fluid pressure is immediately directed to the bucket actuators to effect rollback of the bucket. Once the bucket has reached its extreme rollback position, the other sequencing valve responds to the sudden increase in pressure in the fluid circuit feeding the bucket actuators and opens allowing pressurized fluid to flow to the cradle actuators, effecting rollback to the cradle.

A significant advantage of this feature is that it obviates the need for added operator controls. Even though movement in the bucket assembly occurs in stages and involves the use of multiple fluid actuators, the operator can control the movement in the bucket assembly through a single conventional control. Unlike prior proposed constructions, an additional cumbersome and costly bucket control is not necessary. The operation of the vehicle is essentially unaffected even though dump height is increased.

Another feature of the exemplary embodiment is a bucket latching mechanism which is operative to mechanically lock the bucket in its roll-back position within the cradle. It comprises a fluid pressure operated hook assembly connected to the cradle and a roller, engageable by the hook, rotatably attached to the bucket by a bracket. In normal operation, the bucket is locked into its roll-back position within the cradle until dumping is desired. The fluid pressure control system delivers pressurized fluid to both the hook assembly and the dumping fluid chambers of the bucket actuators so that the bucket is disengaged just prior to dumping. This feature prevents the bucket from being forced from the cradle during digging and scrapping maneuvers, etc.

Other features and a fuller understanding of the present invention will be obtained by reading the following detailed description in connection with the accompanying drawings.

BRIEF DESCRIPTION OF THE DRAWINGS

FIG. 3 is a fragmentary side elevational view of the boom and bucket assemblies in a lowered position with portions omitted for clarity;

FIG. 8 is a perspective view of the bucket;

DESCRIPTION OF THE PREFERRED EMBODIMENT

Figure 1:
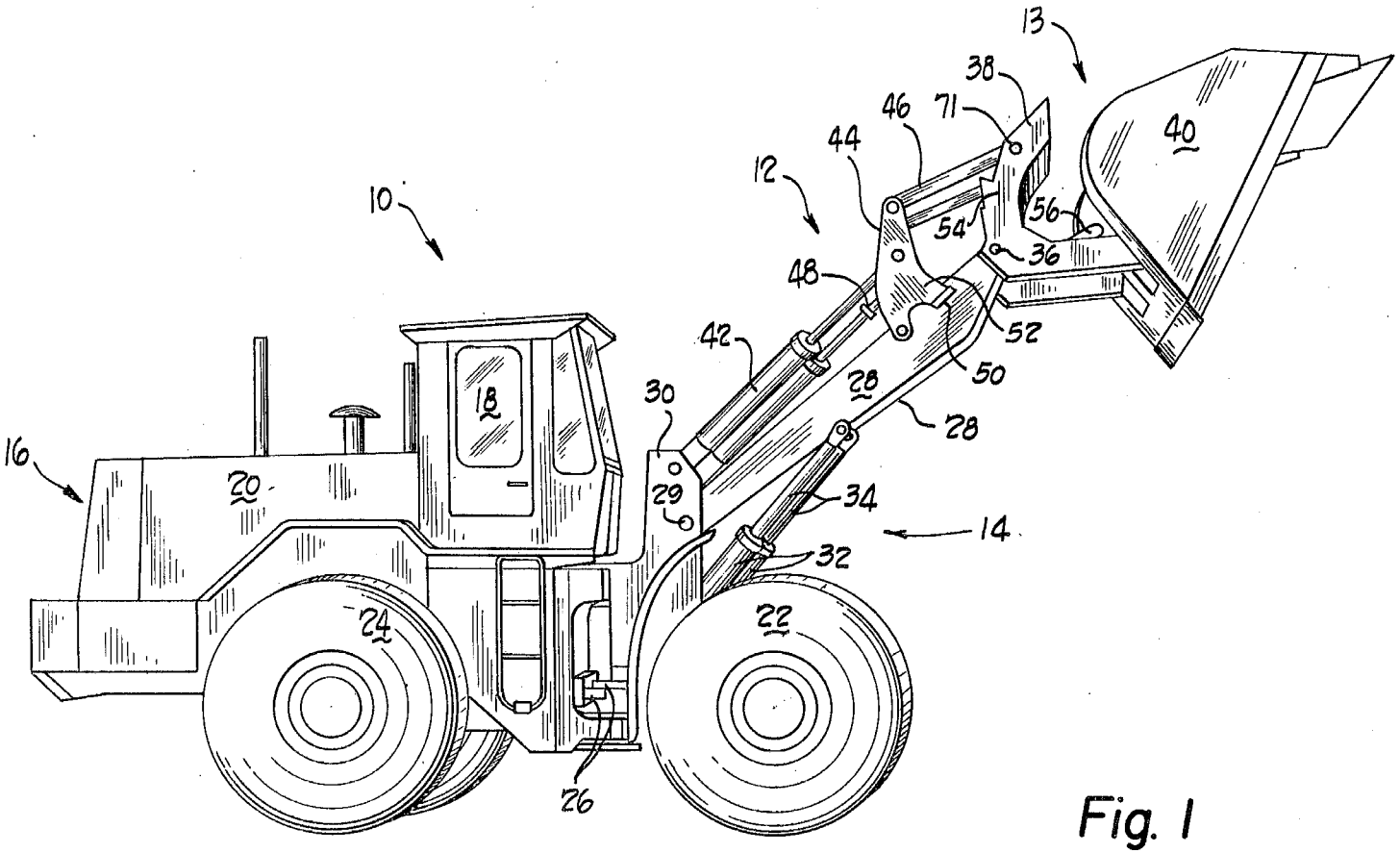
FIG. 1 is a perspective view of a front end loader incorporating boom and bucket assemblies constructed in accordance with the present invention.

FIG. 1 illustrates a front end loader 10 including boom and bucket assemblies 12, 13 constructed in accordance with a preferred embodiment of the invention. The vehicle 10 is of conventional construction and includes an articulated front end 14 and a rear portion 16 that includes a cab 18 and an engine compartment 20. Pairs of front and rear wheels 22, 24 are rotatably mounted on the front end 14 and the rear portion 16, respectively.

The angular orientation of the articulated front end 14 is controlled by a pair of horizontally disposed steering actuators 26 which extend from the rear portion 20 and effect pivotal movement in the front end 14 relative to the rear portion 20. In this way steering of the vehicle is accomplished.

Figures 2, 7:
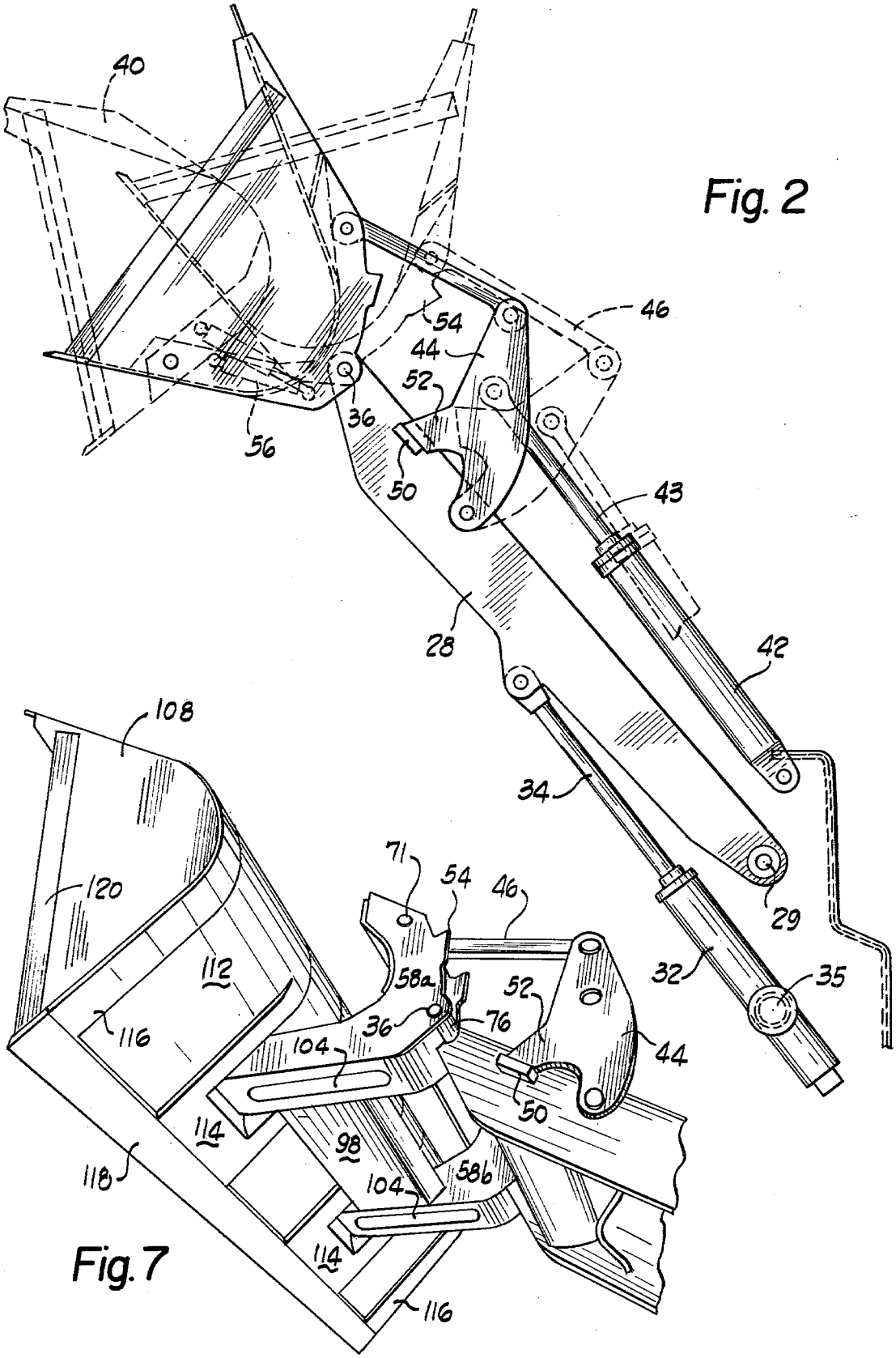
FIG. 2 is a fragmentary side elevational view of the boom and bucket assemblies in a raised position with portions omitted for clarity.
FIG. 7 is a fragmentary perspective view of the boom and bucket assemblies.

Referring also to FIG. 2, the boom assembly 12 is pivotally connected to the front end 14. It includes a pair of boom arms 28 pivotally attached at hinge points 29 to the mounting plates 30 (only one plate 30 is shown in FIGS. 1 and 2) integrally formed with the front end 14. Hydraulic actuators 32 having extensible rods 34 raise and lower the boom arms 28. Each actuator 32 is rotatable about a pivot point 35 on the mounting plates 30 (shown in FIG. 2).

The bucket assembly 13 is pivotally attached to the arms 28 by hinge pins 36. The bucket assembly includes a cradle 38 and a bucket 40. The cradle 38 and the bucket 40 are individually pivotal between their own rollback and dump positions. In the preferred embodiment, a bucket latching mechanism (to be described) is connected to the cradle 38 and is adapted to engage and maintain the bucket 40 in its rollback position within the cradle 38. In FIG. 1, the cradle 38 and the bucket 40 are both shown in their dump positions. FIGS. 2 and 3 illustrate a variety of cradle/bucket positions with the boom raised and lowered, respectively.

As seen in FIGS. 1 and 2, the bucket assembly 13 is rotated by conventional hydraulic actuators 42 having extensible rods 43 operatively connected to cradle operating linkages, each comprising a bell crank 44 and a connecting link 46. At least one of the actuators 42 includes a retraction stop 48. Extending the actuators 42 causes the cradle 38 together with the bucket 40 to pitch forwardly.

The rollback and dump positions of the cradle 38 are controlled by stops or abutments 50 preferably constructed in the form of rectangular blocks welded to the arms 28 as shown in FIGS. 1–3. The stops 50 coact with extensions 52 on the bell cranks 44 to limit the forward travel of the cradle 38. Extensions 54 (one of which is shown in FIG. 3) integrally formed with the cradle 38 contact the stops 50 to limit the rollback position of the cradle.

The bucket 40 is pivotally mounted within the cradle 38. Rotation of the bucket 40 between its rollback and dump positions is accomplished by actuators 56 which are pivotally attached to and act between the cradle 38 and the bucket 40.

Figure 4:
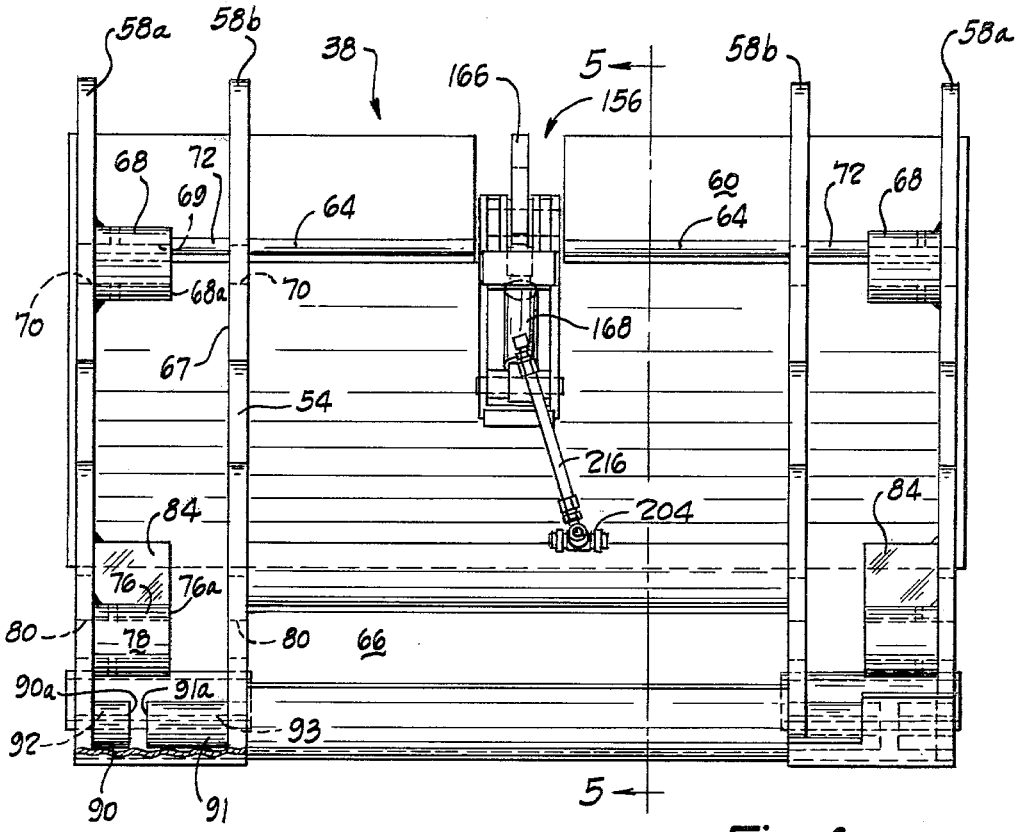
FIG. 4 is a rear elevational view of a cradle constructed in accordance with the present invention.
Figure 5:
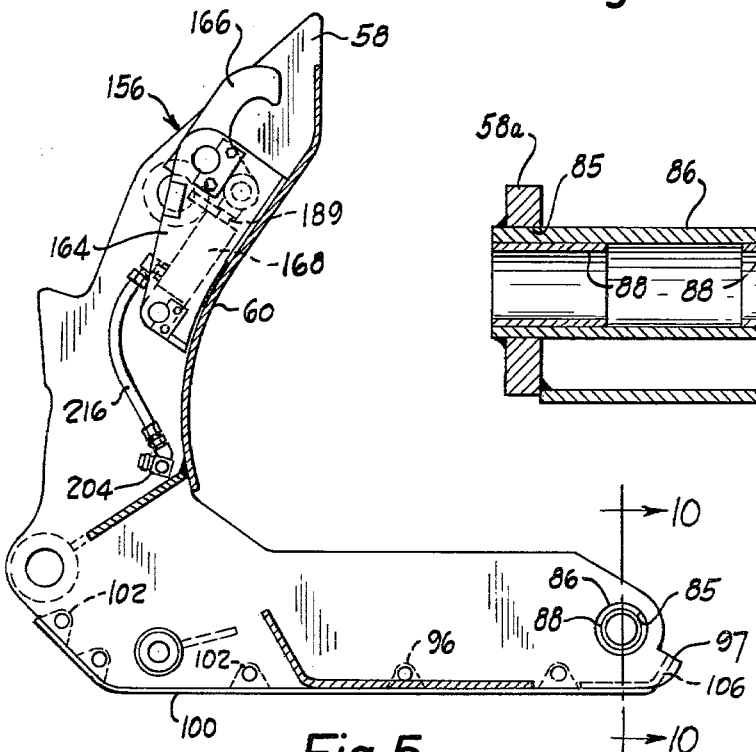
FIG. 5 is a transverse sectional view taken along the line 5—5 of FIG. 4.

Referring to FIGS. 4 and 5, the cradle 38 is preferably a rigid welded assembly including four, spaced C-shaped cradle plates 58, arranged in pairs and welded to an arcuate liner plate 60. To facilitate the description of the cradle assembly 38, the outer cradle plates are designated by the reference character 58*a* and the inner plates by the reference character 58*b*. Reinforcing ribs 64, 66 extend laterally between the inner cradle plates 58*b* and are welded to the liner plate 60.

Each pair of cradle plates includes apertures and bosses by which the cradle is pivotally attached to the vehicle boom arms 28 and the operating linkage 46. The connecting points on the cradle plates are configured so that the boom arms 28 and the connecting links 46 ride between the two adjacent cradle plates 58*a*, 58*b* that form a pair.

As seen in FIG. 4, an upper boss 68 extends transversely from and is welded to the inner side of the upper portion of each cradle plate 58*a*. Each boss 68 includes a through bore 69 coaxially aligned with apertures 70 in each cradle plate 58*a*, 58*b*. The apertures 70 and bosses 68 form the attachment points for the connecting links 46 of the cradle operating linkages (shown in FIG. 1). An apertured end of each link 46 is held between an end surface 68*a* of the boss 68 and the side surface 67 of the cradle plate 58*b* by a hinge pin 71 (see FIGS. 2 and 7) that extends between the apertures 70 and through the bore 69 and the aperture in the connecting link. Gusset plates 72 reinforce the welded mounting of the bosses 68.

Bosses 76 extend transversely from and are welded to the cradle plates 58*a* below the boss 68. Each boss 76 includes a through-bore 78 which is disposed in co-axial alignment with apertures 80 in the cradle plates 58*a*, 58*b*. The cradle assembly 38 is pivotaly attached to each boom arm 28 by a hinge pin 36 (see FIGS. 2 and 7) that extends through the apertures 80 in the paired cradle plates 58*a*, 58*b*, the through bore 78 and an aperture in each boom arm 28. When coupled to the cradle assembly, each arm 28 will ride between an end surface 76*a* of the boss 76 and the side surface 67 of the cradle plates 58*b*. Gusset plates 84 are welded between the bosses 76 and their associated cradle plates 58*a* and provide additional mounting reinforcement.

The lower legs of each pair of cradle plates 58*a*, 58*b*, pivotally mount the bucket 40 and the rod ends of the associated bucket actuators 56. The construction of one of the mounts is shown in detail in FIG. 10 and in the broken-away portion of FIG. 4.

Figure 10:
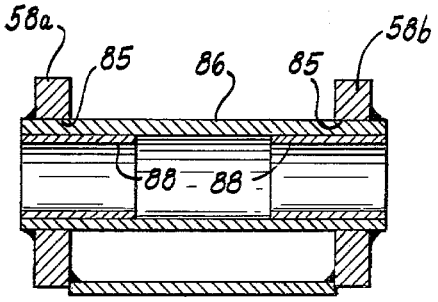

Referring to FIGS. 5 and 10, a sleeve 86 extends through axially aligned apertures 85 in each pair of cradle plates 58*a*, 58*b*. It should be noted that the ends of the sleeve 86 extend slightly beyond the cradle plate surfaces. A pair of bushings 88 are press fitted into each end of the sleeve 86. A bucket hinge pin (see FIG. 6) attaches the bucket 40 to the cradle 38 and, is rotatably supported by the bushings 88. The sleeves 86 thus define a rotational axis for the bucket 40 that is laterally spaced from the rotational axis of the cradle 38.

The mounting for the rod end of each bucket actuator 56 is shown in the lower left portion of FIG. 4. It comprises spaced confronting sleeves 90, 91 that extend laterally from and are welded in aligned apertures of a cradle plate pair 58*a*, 58*b* respectively. The sleeves 90, 91 include aligned through bores 92, 93, respectively, which accept a hinge pin 95 (see FIG. 6) to mount an apertured end 96 of the bucket actuator 56 between the end surfaces 90*a*, 91*a* of the sleeves 90, 91.

The terminating ends of the lower legs of the cradle plate 58 comparatively define a dump stop 97 that limits the forward rotation of the bucket 40 and establishes its dump position. The bottom edges of each pair of cradle plates 58*a*, 58*b* are spanned by a cradle shoe 100 that includes a plurality of apertured projections 102 through which threaded fasteners threadedly engage the interior sides of the pair of cradle plates 58*a*, 58*b*. The shoes 100 each include an elongate slot 104 (shown best in FIG. 7) to prevent the accumulation of debris and dirt, etc. between the cradle plates. The shoes 100, which terminate just below the boss 76, follow the bottom contour of the cradle plates 58*a*, 58*b* and act as skid plates for the cradle and provide protection for the bucket actuator and hydraulic lines mounted between the plates 58*a*, 58*b*. An upturned gusset plate 106 is welded between the cradle plates 58*a*, 58*b* and extends from the shoe 100 to the dump stop 97. An L-shaped skid plate 98 extends between, and is welded to, the lower legs of the two inner cradle plates 58*b*.

Figure 6:
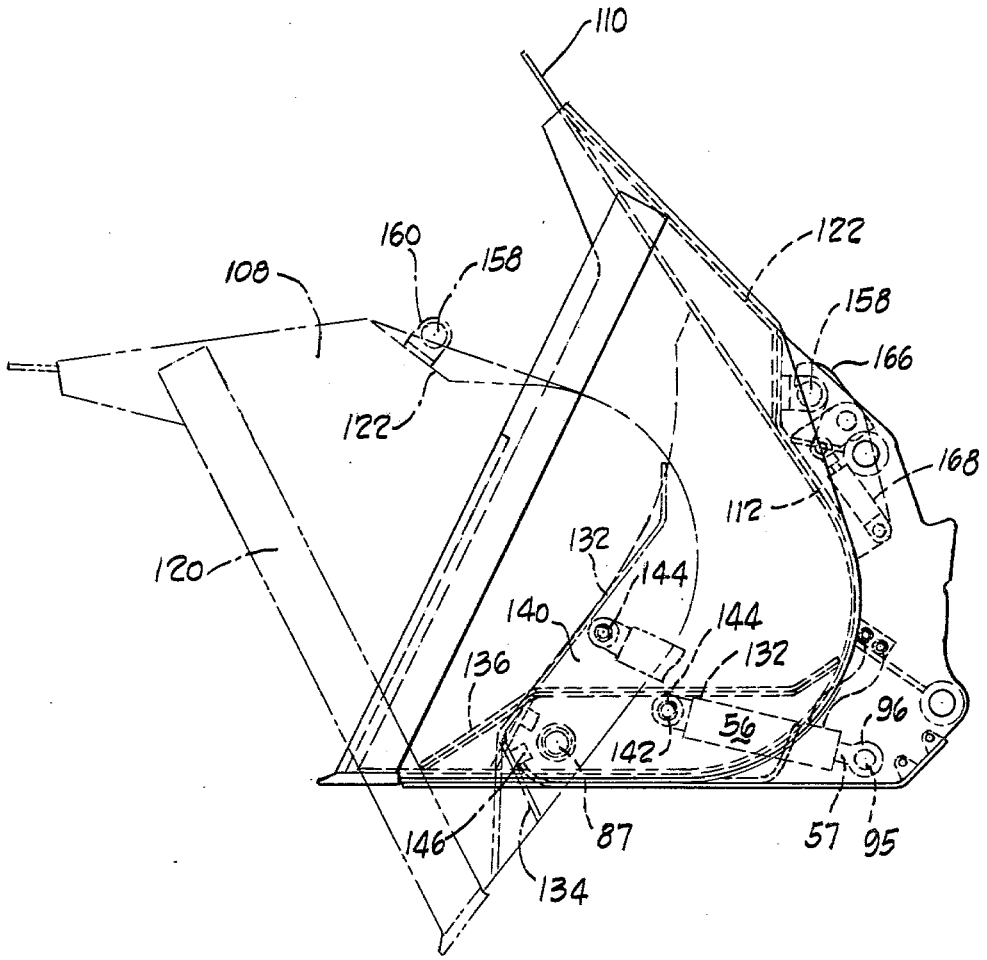
FIG. 6 is a side elevational view of the bucket assembly with an alternate position of the bucket shown in phantom.

Referring to FIGS. 6, 7 and 8, the bucket 40 is preferably a weldment and comprises a pair of V-shaped side plates 108 welded to a substantially continuous arcuate plate formed by an upper sheet 110 and a lower sheet 112 to define an opened trough-like container. The welded seam 113 for the sheets 110, 112 is shown in FIG. 8. Inner and outer reinforced skid surfaces 114, 116 and are mounted to the bottom surface of the lower sheet 112. A cutting edge 118 is welded to the leading edge of the lower sheet 112 and cutting edges 120 are preferably attached to the leading edge of the side plates 108. A downturned plate 122 is welded to the top surface of the upper sheet 110 to form a scalene-shaped box section providing reinforcement for the upper sheet. The exterior of the bucket 40 is shaped to conform to the cradle assembly 38. As seen in FIG. 6, the side profile of the bucket/cradle assembly (when the bucket is retracted into the cradle) is not larger than a conventional bucket and thus the present invention does not reduce the load capacity of the vehicle, nor does it enlarge the moment arm between the bucket and the vehicle when the bucket is in its rollback position.

Referring to FIGS. 6 and 8, a pair of spaced actuator housings 124 project upwardly from the interior surface of the lower sheet 112. The actuator housings comprise side plates 130, a top plate 132 that is welded to the top edges of the side plates 130 and to the lower sheet 112 of the bucket, and a front plate 134. A gusset 136 extends between the lower sheet 112 and the corner formed by the top and front plates 132, 134. As seen in FIG. 8, reinforcing ribs 138 extend between the top plate of each actuator housing and the upper sheet of the bucket.

A flange 140 depends downwardly from the under surface of the top plate 132 in each housing. Each flange 40 includes an aperture for accepting a hinge pin 142 that couples the cylinder end 144 of the hydraulic actuator 56 to the bucket. A bucket stop 146 in the form of a rectangular block is welded to the front plate 132 of each actuator housing 124 and is positioned so that it contacts the dump stops 97 formed on the leading edge of the cradle plates 58 when the bucket is tilted forward.

The bucket 40 is coupled to the cradle assembly 38 by the hinge pins 87 (a portion of one being shown in FIG. 8) which extend through aligned apertures 150 located in the side plates 130 in each actuator housing 124, and the sleeve 86 mounted between the cradle plates 58*a*, 58*b*. A teardrop-shaped mounting plate 152 is welded to one end of the hinge pin 87. When the pin 87 is in its operative position, the plate 152 abuts and is bolted to one of the side plates 130 by a threaded fastener 153. The plate 152 prevents relative rotation and axial movement between the pin 87 and the bucket 40. Consequently, the hinge pins 87 and hence the bucket 40 are rotatably supported by the bushings 88 press-fitted into the sleeves 86 (see FIG. 4).

When the bucket 40 is coupled to the cradle 38, the ends of the sleeve 86 abut the interior surface of each side plate 130 thereby laterally locating the bucket 40 in the cradle 38. The actuators 56 act between the aperture in the flange 140 and the cradle mount formed by the confronting sleeves 90, 91. Extension of the actuator 56, causes the bucket 40 to rotate out of the cradle 38 until the bucket stops 146 contact the dump stops 97 formed at the ends of the lower legs of the cradle plates 58. Retraction of the actuator 56 effects counter rotation of the bucket 40 into the cradle 38.

Figure 9:
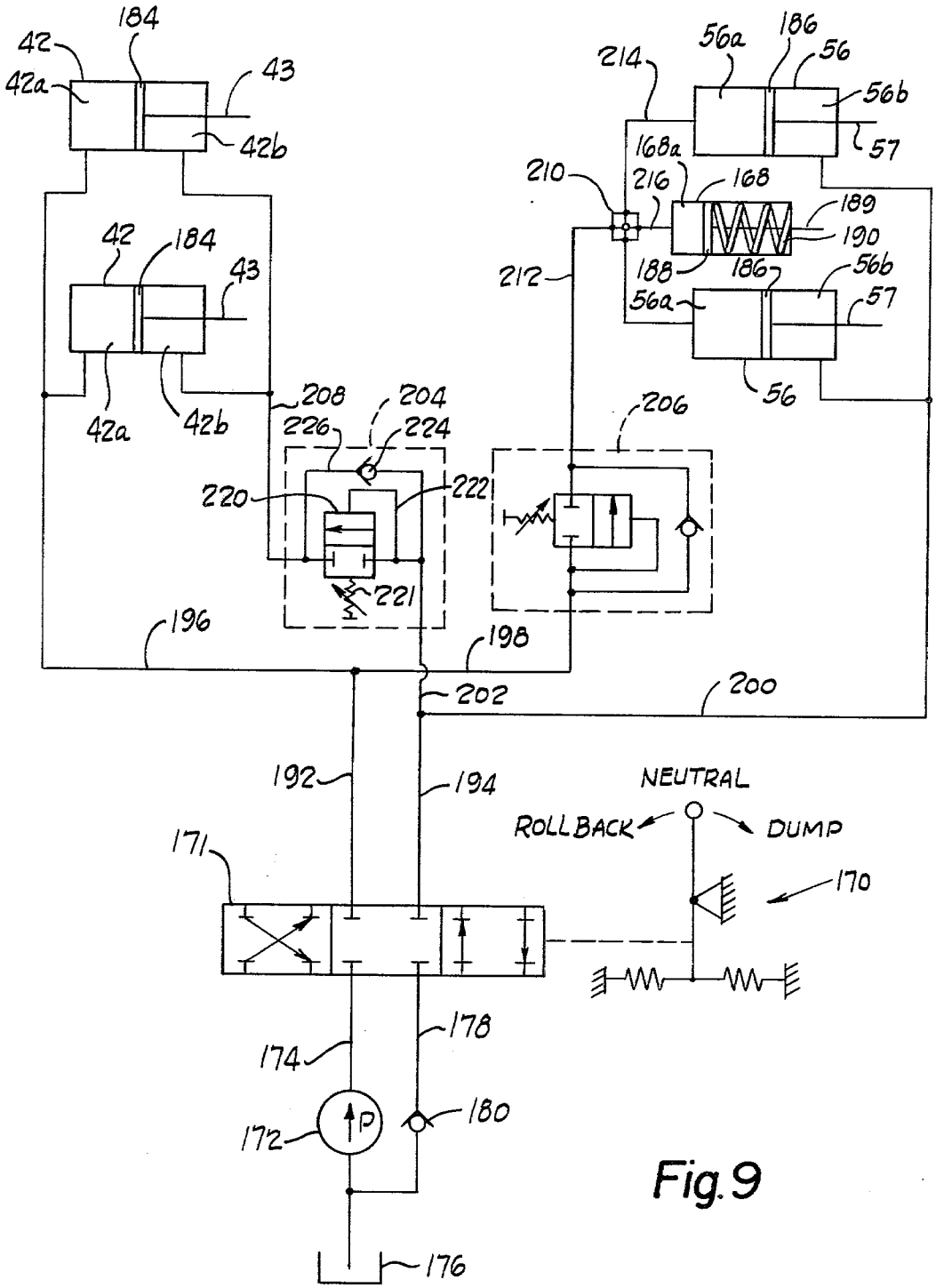
FIG. 9 is a schematic view of the hydraulic control system and components for controlling the bucket assembly; and, FIG. 10 is a cross-sectional view taken along the line 10—10 of FIG. 5.

The bucket actuators 56 are conventional double-acting fluid pressure operated actuators that include non-communicating, extension and retraction pressure chambers 56*a*, 56*b*, shown in FIG. 9. The selective application of pressurized fluid to one of the chambers 56*a*, 56*b* causes an extensible piston rod 57 to extend or retract, respectively. Although the continued application of retraction fluid pressure to the retraction chambers 56*b* of the actuators 56 would normally maintain the bucket 40 in its rollback position within the cradle 38, a bucket latching mechanism preferably is provided to insure that the bucket will not pivot out of the cradle until extension fluid pressure is applied to the extension pressure chamber 56*a*. Referring to FIGS. 4 through 6, the latching mechanism comprises a fluid pressure operated hook assembly 156 mounted in the top center portion of the cradle 38 and a roller 158 rotatably supported by a roller bracket 160 that is centrally fastened to the rear of the reinforcement plate 122, located atop the upper sheet 110 of the bucket 40. It should be noted that the hook assembly 156, the roller 158 and bracket 160 have been omitted from FIGS. 2 and 3 for purposes of clarity.

The hook assembly 156 includes a bracket 164 welded to the liner plate 60 that pivotally mounts a hook 166 and a spring-biased fluid actuator 168 that acts between the bracket 164 and the hook 166. As seen in FIG. 6, extension of the actuator 168 causes clockwise motion in the hook 166. Thus, extension of the actuator causes the hook 166 to disengage the bucket mounted roller 158 thereby allowing the bucket to rotate out of the cradle upon extension of the bucket actuator 56. It should be apparent that rotation of the bucket 40 to its dump position can only occur after the bucket is released by the latching mechanism.

The latching mechanism provides a positive lock and prevents the bucket 40 from being forced out of the cradle 38 during digging and scraping operations, etc. Although other arrangements are contemplated, in the preferred embodiment the hook actuator 168 is moved to its latching position in the absence of extension fluid pressure by an internal spring. This arrangement simplifies the control system for it does not require a separate fluid pressure circuit to achieve latching. The bucket 40 is automatically latched by the hook 166 whenever the bucket rotates to its rollback position in cradle 38.

Referring now to FIG. 9, a schematic of the hydraulic control system and components which operate the bucket assembly 13 is shown. The bucket assembly control system includes an operator control 170 selectively moveable from a neutral position to either a rollback or dump position, and a control valve 171 operatively coupled to the control 170. The control 170 is conventional and as such, normally returns to the neutral position upon release. A fluid pressure pump 172 supplies pressurized fluid to the control valve 171 through a supply conduit 174. Fluid pressure exhausted by the control valve 171 is returned to a reservoir 176 by a return conduit 178 that includes a one-way check valve 180.

The hydraulic actuators 42, 56 respectively include double acting pistons 184, 186. The extensible rods 43, 57 extend axially from the pistons 184, 186 through one end of the respective cylinders. Each actuator 42, 56 includes respective extension pressure chambers 42*a*, 56*a* and retraction pressure chamber 42*b*, 56*b*. The pressurized fluid directed to the chambers 42*a*, 56*a* causes the extension of the rods 43, 57; conversely, the application of pressurized fluid to the chambers 42*b*, 56*b* causes the retraction of the rods 43, 57, respectively.

As shown, the hook actuator 168 is single acting and includes a piston 188, an extension pressure chamber 168*a* and an axially extending rod 189 that is operatively coupled to the hook 166 (See FIG. 5). Retraction of the hook actuator 168 is achieved by the internal spring 190.

Pressurized fluid is conveyed to the actuators 42, 56, 168 by one of two parallel feed conduits 192, 194 that communicate with the control valve 171. When one of the conduits 192, 194 is supplying pressurized fluid to the actuators, the other conduit acts as a return for the fluid exhausted by the actuators. The control valve 171 is shiftable between three positions in response to movement in the operator control 170. When moved to the dump position, the control valve 171 communicates the supply conduit 174 with the feed conduit 192 and communicates the return conduit 178 with the conduit 194. When moved to the rollback position, the conduit 174 is communicated with the feed conduit 194 and the return conduit 178 is communicated with the conduit 192. In the neutral position, the conduits 174, 178 are isolated from the conduits 192, 194.

The conduit 192 divides into branch conduits 196, 198; the conduit 194 divides into branch conduits 200, 202. The extension pressure chambers 42*a* of the actuators 42 and the retraction pressure chambers 56*b* communicate directly with the feed conduits 192, 194 respectively.

The application of pressurized fluid to the retraction chambers 42*b* of the actuators 42 and the extension fluid chamber 56*a*, 168*a* of the actuators 56, 168 is controlled by pressure responsive valves in the form of sequence valves 204, 206 disposed in the associated flow paths. Specifically, the branch conduit 202 communicates the conduit 194 with the input to the sequence valve 204. The output of the sequence valve 204 is conveyed to the retraction chambers 42*b* by a conduit 208. Similarly, the conduit 192 is communicated with the input of the sequence valve 206 by the branch conduit 198. The output of the sequence valve 206 is delivered to a distribution block 210 by a conduit 212. The distribution block 210 (also shown in FIGS. 4 and 5) distributes pressurized fluid to the extension chambers 56*a*, 168*a* by conduits 214, 216, respectively.

The sequence valves 204, 206 are operative to prohibit the flow of pressurized fluid from the conduits 202, 198 to the respective pressure chambers until a predetermined pressure is reached in the conduits. In this way, sequential motion in the cradle 38 and the bucket 40 is achieved using a single operator control.

As shown schematically in FIG. 9, the sequence valve 204 includes a shiftable flow control element 220 that is biased towards a flow interrupting position by an adjustable spring 221. When the element 220 is in the position shown, the flow of pressurized fluid from the conduit 202 to the conduit 208 is blocked. The sequence valve 204 includes a pilot pressure conduit 222 that conveys fluid pressure from the conduit 202 to the valve element 220. When the force of the fluid pressure exceeds that of the biasing spring 221, the valve element 220 shifts position and communicates the conduit 202 with the conduit 208. In the preferred embodiment, the sequence valve includes a check valve 224 and an integral return conduit 226 that allows unrestricted communication between the conduit 208 and the conduit 202 when the valve element 220 is in its flow interrupting position. The purpose of this conduit and check valve is to allow fluid discharged by the retraction chambers 42*b*, during actuator extension, to return, unimpeded, to the conduit 194.

Except for the conduit connections, the sequence valve 206 is identical to the sequence valve 204. It includes the adjustable biasing spring 221, the pilot pressure line 222, the check valve 224 and the internal return conduit 226. The sequence valve 206 is operative to delay the communication of pressurized fluid from the conduit 198 to the extension chambers 56*a*, 168*a* (via the conduits 212, 214, 216) until the actuators 42 have extended and the pressure in the conduit 198 exceeds the pre-set biasing force of the spring 221. It should be noted, that the spring settings on the sequence valves 204, 206 may differ depending on the application and size of the actuators.

Referring now to FIGS. 1, 2 and 9 the method of operation is as follows. Assuming that the boom arms 28 are raised and the cradle 38 and bucket 40 are both in their rollback positions, movement of the operator control 170 to the dump position causes the control valve 171 to communicate the supply conduit 174 with the feed conduit 192 and the return conduit 178 with the feed conduit 194. Accordingly, pressurized fluid is immediately conveyed to the extension pressure chambers 42*a* of the actuators 42 causing the cradle to pitch forwardly until the extensions 52 contact the cradle dump stops 50. At this point, the pressure in the conduit 192 and hence the branch conduit 198 will rise until it exceeds the biasing force on the sequence valve element 220 in the sequence valve 206. Once the biasing force is exceeded, the sequence valve 206 will open and communicate pressurized fluid from the conduit 198 to the conduit 212 from where it will be distributed to the extension fluid pressure chambers 56*a*, 168*a* of the bucket actuators 56 and the hook actuator 168. Because the volume of the extension pressure chamber 168*a* is substantially smaller than the extension pressure chambers 56*a* of the bucket actuators 56, the hook actuator 168 will extend prior to the extension of the bucket actuators 56. Thus, the roller 158 will be disengaged by the hook 166 prior to motion in the bucket. Fluid exhausted by the retraction chambers 42*b*, 56*b* is returned to the reservoir 176 by the feed conduit 194.

Movement of the operator control 170 to the rollback position causes the control valve 171 to communicate the supply conduit 174 with the feed conduit 194 and the return conduit 178 with the feed conduit 192. Pressurized fluid is conveyed directly to the retraction chambers 56*b* of the bucket actuators 56 and thus the bucket will immediately retract into the cradle. The hook actuator 168 will be moved to its latching position by the spring 190 and will engage the roller 158 as the bucket reaches its rollback position. The pressure in the conduit 198 will then increase until it overcomes the biasing force on the sequence valve element 220 whereupon pressurized fluid will be allowed to flow to the retraction chambers 42*b* of the cradle actuators 42 resulting in movement of the cradle 38 to its rollback position.

The bucket assembly and control system disclosed by the present invention increases the dump height of a loader vehicle without adversely affecting vehicle stability or bucket capacity and without requiring added operator controls. Although the cradle 38 and the bucket 40 could be rotated concurrently to their respective dumping positions, the two stage dumping sequence provided by the control system results in an outstanding feature. When the bucket assembly 13 (comprising the cradle 38 and the bucket 40) is retrofitted to an existing boom, the expected moment forces are not substantially increased because in the initial dump sequence, the cradle is pivoted about the hinge points that mounted the original OEM bucket. Expressed another way, for this initial dumping motion, the moment arm, that is, the distance between the front wheel axis and the center of gravity of the loaded bucket is not increased. As the cradle moves from its rollback to its dump position, a portion of the bucket contents is discharged, immediately reducing the maximum moment force prior to rotation of the bucket 40 out of the cradle 38. Thus, although the distance between the front wheel axis and the rotational axis of the bucket is increased, the bucket 40 is only partially loaded as it commences its dumping motion.

When the present invention is installed on new vehicles during manufacture, an increase in dump height is realized over conventional constructions, for a given boom length and vehicle weight. Moreover, the increase in dump height is obtained without excessive cost or at the expense of reliability.

Although the present invention has been described with a certain degree of particularity, it should be understood by those skilled in the art that various modifications can be made to it without departing from the spirit or scope of the invention as described and hereinafter claimed.

What is claimed is:

1. For a front end loader having an elevatable boom, the improvement comprising:

(a) a loading bucket;

(b) a bucket support means pivotally attached to the boom, and rotatably supporting said loading bucket;

(c) means for rotating said bucket support means between rollback and dump positions, on a first rotational axis defined by hinge points on said boom;

(d) means for rotating said bucket between its own rollback and dump positions on a second rotational axis defined by hinge points on said bucket support means, said second rotational axis being laterally spaced from said first rotational axis.

(e) abutments, mounted to said boom, defining dump stops for said bucket support means; and (f) said bucket support means including integrally formed bucket stops for said bucket.

2. The bucket assembly of claim 1 wherein said bucket support means comprises a C-shaped cradle and said bucket is supported by hinge points located on laterally extending legs of said cradle.

3. For a front end loader or the like, having an elevatable boom assembly, a multistage bucket assembly and a fluid pressure control system for operating the bucket assembly, comprising:

(a) a source of pressurized fluid;

(b) a bucket support means pivotally mounted to one end of said boom assembly;

(c) a bucket rotatably mounted to said bucket support means;

(d) first, double acting, fluid pressure operated actuating means for effecting movement in said bucket support means between rollback and dump positions;

(e) second, double acting, fluid pressure operated actuating means for effecting movement in said bucket between rollback and dump positions;

(f) operator control means for controlling the application of pressurized fluid from said source to a supply conduit, said operator control selectively movable from a neutral position to either a rollback or a dump position;

(g) a first branch conduit means communicating said supply conduit with said first actuating means such that movement of said operator control to said dump position effects the direct application of fluid pressure to said first actuating means;

(h) a second branch conduit means communicating with said supply conduit;

(i) fluid pressure operated sequence valve means, for controlling the communication of fluid pressure from said second branch conduit means to said second actuating means, said sequence valve means responsive to pressure in said supply conduit and operative upon a predetermined pressure in said supply conduit, to communicate said second branch conduit means with said second actuating means.

4. The apparatus of claim 3 wherein said bucket support means is a cradle having laterally extending legs that include pivot points that define an axis of rotation for said bucket.

5. The apparatus of claim 3 further including bucket latching means for mechanically locking said bucket in its rollback position under predetermined conditions.

6. The apparatus of claim 5 wherein said bucket latching means comprises a fluid pressure operated hook mounted to said bucket support means and a roller mounted to said bucket, engageable by said hook when the bucket is in its rollback position.

* * * * *